US005640947A

United States Patent [19]

Shute

[11] Patent Number: 5,640,947

[45] Date of Patent: Jun. 24, 1997

[54] COUNTER-TOP COOKING UNIT USING NATURAL STONE

[76] Inventor: Alan B. Shute, 1126 Moulton La., Stowe, Vt. 05672

[21] Appl. No.: 389,192

[22] Filed: Feb. 15, 1995

[51] Int. Cl.[6] ..... F24C 15/10

[52] U.S. Cl. ..... 126/211; 126/39 J; 126/39 E; 126/39 R

[58] Field of Search ..... 126/211, 39 J, 126/39 R, 39 E; 219/10.49, 10.67, 218; 312/236

[56] References Cited

U.S. PATENT DOCUMENTS

| | | | |
|---|---|---|---|
| 3,622,754 | 11/1971 | Hurko | 219/462 |
| 3,632,983 | 1/1972 | Dills | 219/464 |
| 3,645,249 | 2/1972 | Henderson et al. | 126/39 H |
| 3,674,983 | 7/1972 | Hurko et al. | 219/462 |
| 3,686,477 | 8/1972 | Dills et al. | 219/462 |
| 3,740,513 | 6/1973 | Peters, Jr. et al. | 219/10.49 |
| 3,816,704 | 6/1974 | Borom et al. | 219/462 |
| 3,866,018 | 2/1975 | Hurko | 219/460 |
| 3,870,862 | 3/1975 | Doner | 219/464 |
| 3,885,128 | 5/1975 | Dills | 219/462 |
| 4,158,127 | 6/1979 | Husslein | 219/446 |
| 4,177,789 | 12/1979 | Marocco | 125/1 |
| 4,201,184 | 5/1980 | Scheidler et al. | 126/39 J |

(List continued on next page.)

OTHER PUBLICATIONS

Anonymous "Buyline 2502 Introducing a New Stone Technology" advertising brochure publ. by Marble Technics Ltd. (publication date unknown).

Anonymous, "The Origins of Neoparies" pp. 10–13 in Neoparies Akira No. 2, Nippon Electric Glass Co. Ltd. (Jan. 1993).

Anonymous, "Exclusively Neoparies Architectural Panels" advertising brochure publ. by N.E.G. America, Inc. (publication date unknown).

Anonymous, "Exclusively NeoClad Architectural Panels" advertising brochure publ. by N.E.G. America, Inc. (publication date unknown).

*Primary Examiner*—Larry Jones

*Attorney, Agent, or Firm*—Theodore R. Touw

[57] ABSTRACT

A counter-top or free-standing cooking unit with a top surface of natural stone, such as granite, is made especially resistant to cracking and fracture caused by mechanical or thermal stress. The natural stone's perimeter is cut and holes cut to match the diameters of the heating elements to be installed. The stone is preferably annealed for a suitable time at a suitable temperature to relieve stresses introduced by cutting. A reinforcing plate material is selected to have sufficient tensile strength, good thermal conductivity, and a thermal expansion coefficient that matches to some extent the stone's lateral thermal expansion. The plate may be a laminated composite of several metals, chosen such that the thermal expansion of the laminate matches that of the stone as closely as possible. The plate is cut smaller than the stone slab's outer dimensions. Holes are cut in the metal plate, preferably smaller by a predetermined amount than the holes cut in the stone, and large enough to accommodate the gas or electrical feeds to the heating elements. The metal plate is aligned and cemented to the rear surface of the stone, with a thin layer of suitable thermally stable adhesive such as epoxy adhesive. Thin slots for preventing fracture may be cut between the holes and the edge of the stone. The stone is preferably incorporated into a laminate comprising a thin top layer of stone previously prepared with a thin backing layer of perforated-metal, expanded metal, metal mesh, or Fiberglas bonded to it. Also, the stone preferably extends a desired amount laterally along an existing counter, to provide a stone-surface preparation area not occupied by heating elements. The plate may extend under the laterally-extending part of the stone, to a distance from the nearest heating element. In such embodiments there may be a gap, slot, or series of slots in the metal plate, providing thermal resistance to keep the stone preparation surface area relatively cool.

12 Claims, 2 Drawing Sheets

U.S. PATENT DOCUMENTS

| | | | |
|---|---|---|---|
| 4,243,016 | 1/1981 | Kristen et al. | 126/211 |
| 4,267,815 | 5/1981 | Gössler | 126/39 G |
| 4,347,431 | 8/1982 | Gössler | 219/449 |
| 4,363,956 | 12/1982 | Scheidler et al. | 219/464 |
| 4,453,533 | 6/1984 | Scheidler et al. | 126/211 |
| 4,489,234 | 12/1984 | Harnden, Jr. et al. | 219/347 |
| 4,491,722 | 1/1985 | Fischer et al. | 219/458 |
| 4,492,217 | 1/1985 | Scheidler | 126/39 B |
| 4,538,590 | 9/1985 | Oh | 126/390 |
| 4,580,550 | 4/1986 | Kristen et al. | 126/39 J |
| 4,622,948 | 11/1986 | Oh | 126/390 |
| 4,625,098 | 11/1986 | Joe | 219/462 |
| 4,640,850 | 2/1987 | Morocco | 428/15 |
| 4,740,664 | 4/1988 | Payne et al. | 219/449 |
| 4,755,655 | 7/1988 | Reiche et al. | 219/449 |
| 4,848,311 | 7/1989 | Dorri | 126/21 R |
| 4,869,231 | 9/1989 | Rice et al. | 126/214 R |
| 5,036,831 | 8/1991 | Ray | 126/211 |
| 5,046,477 | 9/1991 | Bennett et al. | 126/39 B |
| 5,131,378 | 7/1992 | Marocco | 125/16.01 |
| 5,138,135 | 8/1992 | Husslein et al. | 219/464 |
| 5,185,047 | 2/1993 | Ray | 156/242 |
| 5,226,402 | 7/1993 | Marocco | 125/12 |
| 5,227,610 | 7/1993 | Schultheis et al. | 219/449 |
| 5,261,387 | 11/1993 | Gressenich | 126/39 H |
| 5,274,963 | 1/1994 | Tsur | 51/283 E |
| 5,295,476 | 3/1994 | Herbert | 126/39 G |
| 5,313,929 | 5/1994 | Thürk et al. | 126/39 B |
| 5,317,129 | 5/1994 | Taplan et al. | 219/464 |
| 5,352,864 | 10/1994 | Schultheis et al. | 219/449 |

COUNTER-TOP COOKING UNIT USING NATURAL STONE

FIELD OF THE INVENTION

This invention relates to cooking appliances. More particularly, it relates to a cooking appliance using natural stone for its top surface. It also relates to methods of manufacturing and installing natural-stone counter-top cooktops.

BACKGROUND OF THE INVENTION

Many useful and attractive man-made materials are in common use for the top surfaces of cooking appliances and for kitchen counter-top cooking units (cooktops). Popular materials include enameled steel and ceramic glass materials such as "Ceran"™ made by Schott Glaswerke of Germany. Other materials such as "Formica"™ and DuPont "Corian"™ plastic-type material are commonly used for food preparation countertops. However, the natural beauty, the hard surface resistant to scratching and denting, ease of cleaning, and the impermeability of natural stone make it a desirable material with which to fabricate cooktops and adjacent areas of countertops. This is especially true of natural granite. Each individual counter-top cooking unit made of granite has a unique natural appearance determined by its natural visual texture and the combinations of grain sizes and colors formed by nature. It is also useful for a cooking appliance to have a continuous extension of its top surface to serve as a food preparation surface area of natural stone. A cool stone surface is especially useful in the preparation of pastry for baking.

Heretofore, custom counter-top cooking appliances using natural stone have been relatively expensive due to the cost of procuring natural stone which is cut and polished to fit, and due to the skills required to install stone. A more troublesome problem, however, has been the tendency of natural stone to crack and fracture when subjected to thermal stresses. What is needed to improve the usefulness of natural stone cooktops is a natural stone cooktop surface with improved strength (especially improved tensile and flexural strength), with resultant improved resistance to cracking and fracture. A natural stone countertop cooking appliance that is relatively easy to install, to custom-fit to a kitchen space, and to equip with custom heating-element arrangements is also needed. A most useful natural stone cooktop would be one that is readily made to accommodate various types and sizes of heating elements. Commercial viability of natural stone cooktops requires avoiding excessive weight and excessive cost to the user for procurement and installation of natural stone.

NOTATIONS AND NOMENCLATURE

The term "natural stone" is used in this specification and the appended claims to mean stone that occurs in the natural environment, as distinguished from synthetic or artificial stone-like materials manufactured by man, or other man-made imitation materials that are merely intended to have the appearance of stone. Examples of natural stone are natural granite, limestone, marble, serpentine stone, amphibole stone (such as hornblende), and soapstone. The term "cracking" is used herein to mean breaking with appearance of one or more surface fissures without parting, while "fracturing" is used herein to mean breaking with parting.

DESCRIPTION OF THE RELATED ART

Popular materials commonly used for the top-surface or hob of cooking appliances are glass ceramic materials or the like which are friable, and potentially subject to cracking and/or fracture when subjected to excessive temperatures or excessive temperature gradients. Various approaches have been taken to solve this problem or other similar problems in the related art. U.S. Pat. No. 4,491,722 by Fischer et al. discloses a mounting arrangement for an electric hot plate with a support ring surrounding it, which is fitted into a glass or ceramic built-in plate using a flat S-shaped intermediate ring. In U.S. Pat. No. 4,755,655 (1988), Reiche et al. disclose a thermal protection arrangement for a glass cooktop having solid disk cast iron surface units. Thermally responsive switching devices (responsive to the temperature of a cover element covering the underside of the surface unit) cut off power to resistive heating elements when the sensed cover member temperature exceeds a predetermined threshold. U.S. Pat. No. 5,185,047 (1993) by Ray discloses a frameless glass-ceramic cooktop mounting assembly using a unitary ring member for supporting the periphery of a glass-ceramic panel. The ring member is secured to the bottom face of the cooktop panel with a sealant, such as silicone.

In U.S. Pat. No. 5,227,610 (1993), Schultheis et al. show a process and device for detecting and indicating an anomalous thermal stress condition in a heating surface made from glass ceramic or a comparable material. One or more temperature sensors independent of one another detect the temperature distribution in the heating surface characteristic of a specific anomalous thermal stress condition. Optical and/or acoustic warning devices alert the user to harmful operating conditions. In U.S. Pat. No. 5,313,929 (1994), Th ürk et al. disclose an arrangement for mounting gas burners in molded parts made of a brittle-friable material such as glass, glass-ceramic, or ceramic. The molded part is the sole support for the gas burners, but if it breaks, the gas burners will drop onto a lower metal support. U.S. Pat. No. 5,352,864 (1994) by Schultheis et al. shows a process and device for output control and limitation in a heating surface made from glass ceramic or a comparable material, especially a glass ceramic cooking surface. In a heating surface where the individual heating zones are each heated with several heating elements (individually switchable and controllable independently), several independent temperature sensors can detect a stress case. The individual heating elements are switched and controlled so that the output distribution in the heating zone area matches the locally varying removal of heat.

There have also been some difficulties in the related art with respect to neat installation of accessories into stone counter tops. In U.S. Pat. No. 5,274,963 (1994), Tsur discloses flush-fit mounting of an accessory such as a sink or bowl in a surface of hard material such as granite or marble, using a beveled edge method similar to a method used with DuPont "Corian"™ plastic-type mounting surface material. The method uses a router tool with a conically shaped diamond cutting bit. The precision achieved in the beveled edge is said to make the method feasible for many different accessories, such as stovetop burners.

PROBLEMS SOLVED BY THE INVENTION

The problems that have prevented widespread use of natural stone for cooktop surfaces are mainly related to the difficulty of preventing the stone from cracking and fracturing due to excessive thermal gradients, without resorting to stone slabs so thick as to be unduly heavy and expensive to procure and cut to the desired size and shape. This invention solves those problems and provides a natural stone cooktop with improved robustness and versatility at a more affordable cost to the user than has heretofore been possible.

OBJECTS AND ADVANTAGES OF THE INVENTION

One object of the invention is a new use for natural stone materials commonly used for architectural structural materials and for decorative coverings for buildings. An important object of the invention is a counter-top cooking appliance made using natural stone, while avoiding excessive weight and excessive procurement costs. Another object of the invention is a counter-top cooking unit such that each individual cooktop has a unique natural appearance determined by its natural visual texture and the combinations of grain sizes and colors formed in nature. Another object of the invention is a natural stone cooktop surface with improved strength, especially improved tensile and flexural strength. Another object is a cooking appliance surface that is hard, not easily scratched or dented, and easy to clean. An object is a natural stone countertop cooking appliance that is relatively easy to install to custom-fit a kitchen space, and with custom heating-element arrangements. A related object is a natural stone cooktop readily adaptable to various types and sizes of heating elements. Yet another object is a cooking appliance whose top surface can extend continuously to a food preparation countertop surface area of natural stone. A related object is a cooking unit whose extended countertop surface is especially suitable for preparing pastry. An important object is a natural stone cooking appliance surface which is resistant to cracking and fracture accidents, especially such accidents due to stresses induced by thermal gradients. A related object is a stone cooktop surface which, even if subject to cracking, will be resistant to fracture and will remain functional. A particular object of the invention is a natural cooktop surface that has improved ability to withstand harmful thermal stresses caused by inferior cookware or by operational errors of a user. Other objects, features, and advantages of the invention will be evident from the detailed description below and the accompanying drawings.

SUMMARY OF THE INVENTION

The invention is a counter-top cooking unit with a top surface of natural stone, such as granite, made especially resistant to cracking and fracture caused by thermal stress. To make a custom cooking unit, a template is made of the desired size of stone counter-top, with desired sizes and positions of cooking elements, in the same manner as in making a custom counter-top of conventional kitchen counter materials. A natural stone material is selected, such as natural granite, limestone, marble, serpentine stone, amphibole stone (such as hornblende), or soapstone. The stone is cut to match the template, with size and holes cut to match the diameters of the burners to be installed. The stone is preferably annealed after cutting. A metal plate material is selected to have sufficient tensile strength, good thermal conductivity, and a thermal expansion coefficient that matches to some extent the stone's lateral thermal expansion. Natural stone materials vary somewhat in their thermal expansion coefficients depending on their exact compositions, which vary naturally according to the conditions of their formation in nature. Some natural stones may also be anisotropic in their thermal expansion. The metal plate may itself be a laminated composite of several metals, chosen such that the thermal expansion of the metal laminate matches that of the stone as closely as possible. The metal plate of suitable thickness is cut to a size smaller than the stone slab's outer dimensions by a predetermined amount. Holes are cut in the metal plate, equal in size or smaller by a predetermined amount than the holes cut in the stone. These holes in the metal plate are made large enough to accommodate the gas or electrical feeds to the burners. The metal plate is aligned and cemented to the rear surface of the stone, with a thin layer of suitable thermally stable adhesive, e.g. epoxy, preferably a resilient adhesive.

The stone may be 2 to 5 centimeters thick or more, for example, but preferably should be incorporated into a laminate comprising a thin top layer of stone (about 6 millimeters inch thick or less) previously prepared with a thin perforated-metal backing layer (about 1 mm thick or less) bonded to it. The metal plate mentioned above mechanically reinforces the stone and also helps to distribute the heat more uniformly, reducing thermal gradients, and thus preventing cracking and fracture of the stone. Otherwise, without a metal plate, excessive thermal gradients could be generated, for example, when a large hot cooking pan is left on the burner too long and gets very hot. Without a metal plate, an overheated cooking pan could cause the stone to crack, with the crack propagating from the outside edge of the stone and extending quickly inward toward the burner hole. An artificial crack which tends to prevent accidental cracking may be made in one embodiment of the invention.

Also in the method of this invention, the stone is preferably made to extend a desired amount laterally along an existing counter, to provide a stone surface not occupied by burners. The extended area of natural stone surface may be used for setting down cooking dishes, for example, and is especially useful for preparing dough for pastry. The metal plate may extend under that laterally extended part of the stone, at least to some distance from the nearest heating element, but preferably is not a completely continuous metal plate from the heating elements to the extended area. A narrow gap, slot, or series of slots in the metal plate may be used to introduce a thermal resistance which helps to keep the area not occupied by heating elements relatively cooler.

For gas burners with exposed visible gas flames, the opacity of most natural stone materials to light is not a problem. For electric heating elements covered by an opaque surface (such as cast iron), a transparent ring of heat-resistant glass may be used between the heating element rim and the stone surface to transmit light from a light source under each burner to the peripheral edge of the glass ring, indicating at one or more brightness levels that the electric heating element is being heated.

DETAILED DESCRIPTION OF THE PREFERRED EMBODIMENTS

Figure 1:
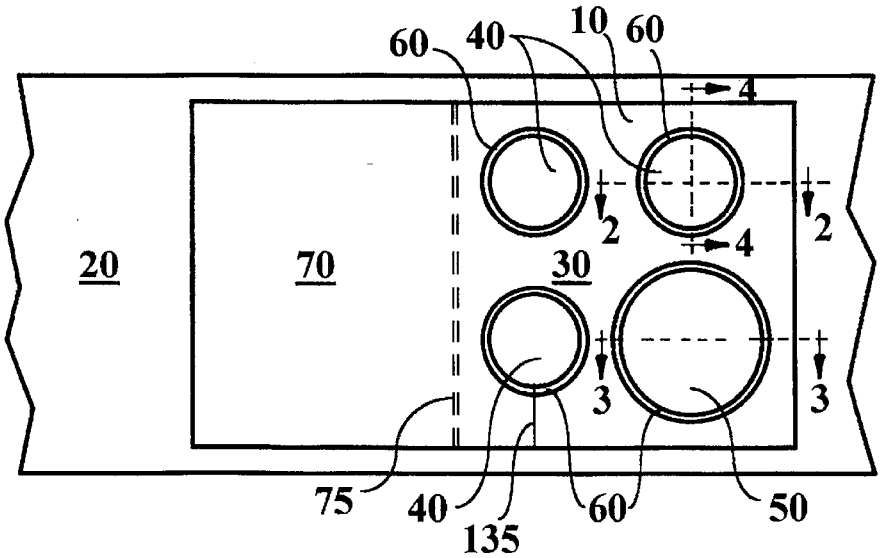
FIG. 1 shows a top view typical of several embodiments of a natural stone cooktop made in accordance with the invention.

FIG. 1 shows a top view typical of several embodiments of a natural stone cooktop made in accordance with the invention. A cooktop 10 is mounted into an opening in the top of a kitchen range or countertop 20. A natural stone top surface layer 30 of cooktop 10 is made of a preferred type of natural stone such as granite. Apertures 40 and 50 are cut out of natural stone layer 30 to accommodate the various desired sizes and shapes of heating elements. A metal plate 60 is bonded to the lower surface of stone layer 30. Metal plate 60 is chosen to have a coefficient of thermal expansion that is close to the thermal expansion of natural stone layer 30. If natural stone layer 30 is a type of stone that is anisotropic in thermal expansion, metal plate 60 is chosen to match the stone's lateral expansion (i.e. in the plane of the stone slab's major surfaces). Thermal coefficients matching to within less than about 50% of the natural stone's expansion are preferred to prevent cracking or fracture. The metal plate 60 is made slightly smaller than stone layer 30, and holes (smaller than those cut in stone layer 30) are cut in metal plate 60, preferably before bonding plate 60 to stone layer 30. Holes cut in plate 60 are made large enough to accommodate the feed lines of electric power or gas and corresponding connections to the heating elements of the cooktop. The heating elements, which may be of many different types and sizes, are conventional and are therefore not shown in the drawings. They may include gas burners, electric conduction heating elements, electric induction heating elements, or electromagnetic radiation elements such as halogen elements, for example. Natural stone top layer 30 of the cooktop preferably extends (left or right) along countertop 20 to form a food preparation area portion 70 beyond the area needed to accommodate heating elements. Metal plate 60 may extend under at least a portion of food preparation area 70, and may even extend under the entire area of cooktop 10, except for a small border area. While metal plate 60 may extend under part of the stone of preparation area 70, it is preferably not a continuous plate from the heating elements to food preparation area 70. A narrow gap 15 slot, or series of slots (not shown) in metal plate 60 may be used to introduce a thermal resistance which helps to keep the area 70 not occupied by heating elements relatively cooler.

Figure 2:
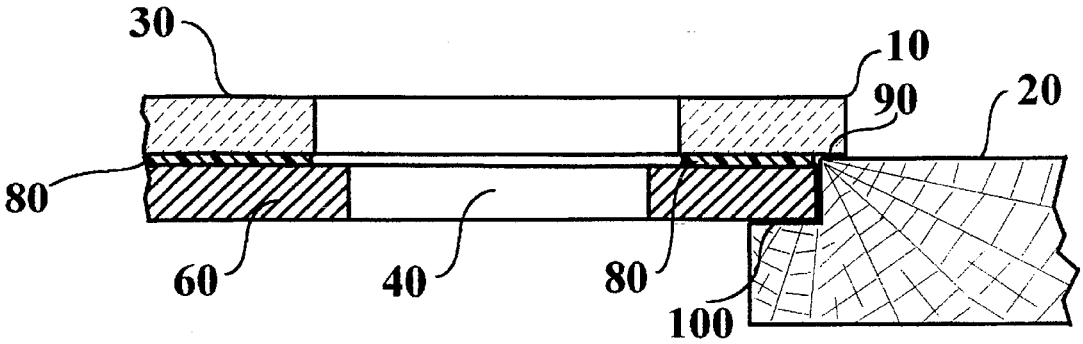
FIG. 2 shows a partial cross-section view of one embodiment of a cooktop, taken at section 2—2 of FIG. 1.

FIG. 2 shows a partial cross-section view of one embodiment of a cooktop, taken at section 2—2 of FIG. 1. (FIG. 2 is not drawn to scale and specifically not to the same scale vertically and horizontally. For example, the size of heating element aperture 40 is relatively compressed for clarity.) In this simple embodiment, natural stone layer 30 is bonded to metal plate 60 by a thin layer 80 of a thermally stable, preferably resilient adhesive. Adhesive layer 80 may be a high-temperature epoxy adhesive for example, and may contain filler material such as fine metal particles to enhance its thermal conductivity. Adhesive layer 80 is made as thin as possible while performing its bonding function, to minimize the thermal resistance between natural stone layer 30 and metal plate 60. Metal plate 60 is preferably a steel plate at least 3 millimeters thick, and preferably more than 6 millimeters thick, for a stone layer 30 more than 12 millimeters thick. FIG. 2 illustrates the preferred arrangement in which heating element apertures 40 (or 50) are made smaller in metal plate 60 than in stone layer 30, and a border portion 90 of stone layer 30 is left uncovered by metal plate 60. Cooktop 10 is preferably supported by countertop 20 under a portion 100 of metal plate 60. It will be apparent that cooktop 10 may be mounted flush with countertop 20 if desired by suitable shaping of the edge of the countertop opening. If desired, this could be done using a method similar to that disclosed in U.S. Pat. No. 5,274,963 (1994) by Tsur, mentioned hereinabove.

Figure 3:
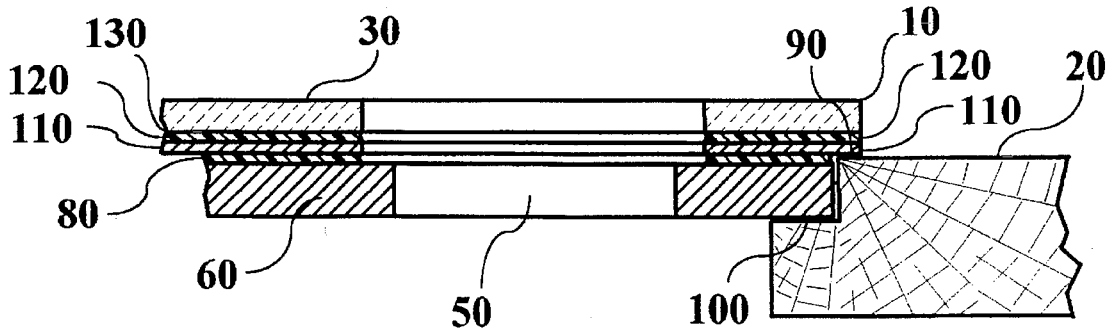
FIG. 3 shows a partial cross-section of a preferred embodiment of a cooktop, taken at section 3—3 of FIG. 1.

FIG. 3 shows a partial cross-section of a preferred embodiment of a natural stone cooktop, taken at section 3—3 of FIG. 1. It should be understood that FIG. 1 represents either of the embodiments of FIG. 2 or FIG. 3, and that sections 2—2 and 3—3 of FIG. 1 are equivalent. In other words, the structures illustrated in cross-section FIGS. 2 and 3 are presented here as alternatives, and would normally not both be used in the same embodiment. In the embodiment of FIG. 3, natural stone layer 30 is made relatively thinner, but is reinforced by bonding to a thin layer of expanded or perforated metal backing layer 110, using a thermally stable adhesive layer 120. Metal backing layer 110 is preferably made of thin perforated metal (or expanded metal mesh), in part to save weight. Adhesive layer 120 need not be the same adhesive composition as adhesive layer 80. Stone laminate 130 (comprising a thin natural stone layer 30, a thermally stable adhesive layer 120, and a thin metal backing layer 110) may be prepared in advance of assembly with metal plate 60. As such stone laminates are commercially available, stone laminate 130 may be purchased prefabricated. Although it was noted above that the embodiments of FIG. 2 and FIG. 3 would not normally both be used, such a combination could be used for example to provide a cooktop (not shown) with two or more different stepped levels of stone top surface if desired.

In an alternate embodiment, natural stone layer 30 (or stone laminate 130 including a natural stone layer 30) may be cut intentionally to provide a virtually invisible "artificial crack." A fine straight cut 135 is made from the edge of natural stone layer 30 or stone laminate 130, extending to heating-element apertures 40 and 50 and between those apertures. The stone layer 30 or stone laminate 130 is pressed back together to close the kerf of the cut before attaching metal plate 60 to the stone or stone laminate with adhesive layer 80. By providing for a small amount of differential expansion, such an artificial crack tends to prevent accidental cracking that might occur, for example, if a cooking utensil larger than a heating element is overheated, causing high temperature gradients near the heating element.

Figure 4:
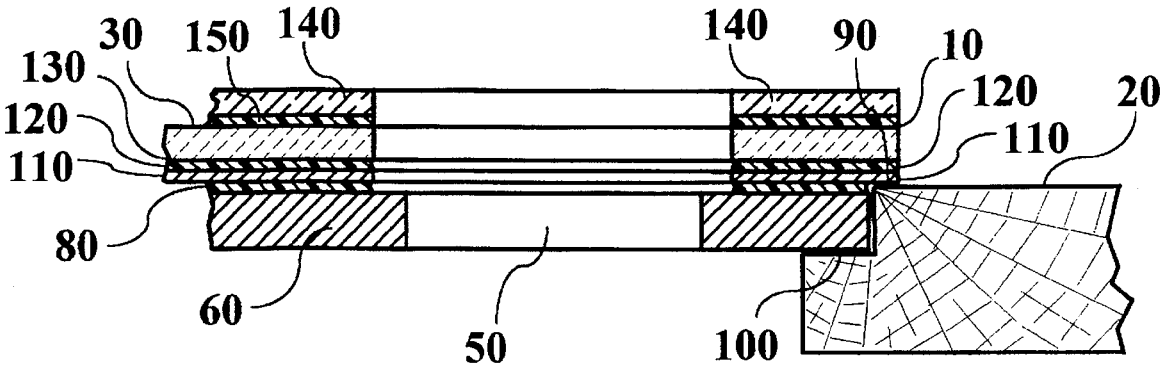
FIG. 4 shows another embodiment in a partial cross-section view, taken at section 4—4 of FIG. 1.

FIG. 4 shows another embodiment, having a transparent glass layer 140 and a transparent adhesive layer 150 used to bond transparent glass layer 140 to the top surface of natural stone layer 30.

Processes for preparing thin stone laminates for mechanical strength and low cost are known in the art of building construction, viz. facings for buildings. U.S. Pat, Nos. 4,177,789, 5,131,378 and 5,226,402 by Marocco disclose processes that can be used for making reinforced stone cladding materials of this type. Preferred materials for stone laminate 130 are RS1, RS4, or RS7, reinforced stone products of Marble Technics Ltd. of New York, N.Y. and Los Angeles, Calif. (a division of Tecnomaiera-Fornara Group of Italy).

The invention will be further clarified by considering the following examples, which are intended to be purely exemplary of the use of the invention.

In the course of many experiments aimed at using natural stone (and especially granite) as a cooktop, I have found that a natural stone cooktop can be heated to quite high temperatures without damaging effects. This is especially true if the stone is not constrained, as for example in a rigid frame of the type commonly used with other types of cooktops. However high temperature gradients are harmful to the stone cooktop. For example, in an experiment with a granite cooktop of 1¼ inches (about 32 millimeters) thickness, a temperature gradient of 90 degrees Fahrenheit over 3 inches (about 76 millimeters) was sufficient to cause a crack to propagate from an edge of the cooktop to the hot cooking element. In contrast, however, cooktops made according to the invention disclosed herein were able to withstand such temperature gradients without cracking or fracturing, even with markedly thinner layers of natural stone.

To make a custom counter-top cooking unit using natural stone in accordance with this invention, a template is made of the desired size of counter-top cooking unit, in the same manner as in making a counter-top of conventional kitchen counter materials. The desired sizes and positions of cooking elements are also marked on the template. For an embodiment similar to that illustrated in FIG. 2, granite or other suitable natural stone is cut to match the template, with size and holes cut to accommodate the diameters of the burners to be installed. In one of the simplest embodiments a steel plate approximately 6 millimeters thick (preferably greater than 3 millimeters thick) is cut to a size smaller than the granite slab outer dimensions by a predetermined amount, preferably about 10 millimeters. Using the template or the stone, holes are laid out on the steel to align with the holes made in the granite. These holes in the steel plate are made smaller by a predetermined amount (preferably about 30 millimeters smaller) than the holes cut in the granite. These holes in the steel plate are of course made large enough for gas or electrical feeds to the burners. The steel plate is aligned and cemented to the rear surface of the granite, with a thin layer of suitable thermally stable and preferably resilient adhesive, for example an epoxy adhesive. In a preferred process, the natural-stone element 30 of the cooktop is annealed at a temperature and for a time suitable for the particular type of natural stone. This annealing is done after cutting the stone outline and the heating-element apertures 40 and/or 50, but before laminating it with plate 60 and installation of the cooktop, to relieve stresses introduced by cutting processes.

To make an embodiment of the invention like the preferred embodiment of FIG. 3, a similar method is used, with substitution of a thinner natural-stone laminated composite for the granite used in the previous example. Other embodiments without a thick steel plate may be made similarly, for example, by using a thin stone laminated composite having a reinforcing layer of sheet steel, perforated steel, expanded steel, steel mesh, or Fiberglas. Metals other than steel having suitable tensile strength, thermal expansion, and thermal conductivity would also work for this purpose, although perhaps at greater cost. The metal plate may itself be a laminated composite of several metals, chosen such that the thermal expansion of the metal laminate matches that of the stone as closely as possible. As is known in related arts, such a laminated metal composite may be made with a core metal layer clad on both sides symmetrically with a second metal of suitable expansion coefficient, so that the composite's thermal expansion does not result in flexure.

In an embodiment in which an "artificial crack" is intentionally made as described hereinabove, two fine cuts may be made in the stone or stone laminate surface of a cooktop arranged like the cooktop illustrated in FIG. 1 for example. (These cuts are not shown in FIG. 1). One cut may be made from front to rear through each pair of apertures, aligned with the centers of apertures 40 and 50. The stone surface in such an embodiment has three portions separated by the two kerfs. Then the kerfs of the two cuts are closed by pressing the three portions together laterally, and the three portions of stone layer 30 or stone laminate 130 are each attached to metal plate 60 with an adhesive layer 80. With sufficiently fine straight cuts, the "artificial cracks" are virtually invisible.

Because the natural stone materials of the invention are often opaque to light in a thickness of practical use, it is often convenient to provide a ring of heat resistant material that is transparent or at least translucent, mounted between a heating element and the cooktop surface. It will be apparent that such a ring is not needed for gas burners with a visible flame. For electric heating elements, such a ring serves to transmit light from a heating element out to the rim of the ring, as is known in the related art. Such rings may be made of heat-resistant borosilicate glass such as Pyrex™ or Robax™, or glass ceramic materials such as those mentioned hereinabove.

From a consideration of this specification or from practice of the invention disclosed herein, those skilled in the art can easily ascertain the essential characteristics of this invention, and without departing from the spirit and scope thereof, can make various changes and modifications of the invention to adapt it to various usages and conditions. For example, the invention may be used in cooktops made using synthetic stone materials, such as "Neoparies,"™ a crystallized glass synthetic stone architectural panel material available from Nippon Electric Glass Co., Ltd. of Japan and N.E.G. America, Inc. of Itasca, Ill. and disclosed in U.S. Pat. No. 5,061,307. It is intended that the specification and examples be considered as exemplary only, with the true scope and spirit of the invention being defined by the following claims.

Having described my invention, I claim:

1. A cooktop, comprising:

a) a first laminated panel having top and bottom major panel surfaces, said first laminated panel having one or more first apertures therein for accepting heating elements, said first laminated panel comprising:

i) a natural stone layer having top and bottom major stone surfaces, ii) a first adhesive layer disposed against said bottom major stone surface, and iii) a metal layer, said metal layer being disposed against said first adhesive laver and being bonded by said first adhesive layer to said bottom major stone surface, thereby reinforcing said natural stone layer;

b) a plate characterized by having tensile strength and thermal conductivity greater than those of said natural stone layer, said plate being disposed parallel to said laminated panel, said plate having one or more second apertures, each of said second apertures being aligned under one of said one or more first apertures to allow energy input to said heating elements; and c) a second adhesive layer disposed between said plate and said bottom major surface of said first laminated panel, thereby securing said plate to said first laminated panel.

2. A cooktop as in claim 1, wherein said first laminated panel further comprises:

iv) a transparent glass layer disposed above said top major stone surface, and v) a transparent third adhesive layer disposed between said top major stone surface and said transparent glass layer, whereby said transparent glass layer is bonded to said natural stone layer.

3. A cooktop as in claim 1, wherein said metal layer comprises steel selected from the list consisting of:

a) perforated steel, b) expanded steel, and c) steel mesh.

4. A cooktop as in claim 1, wherein said natural stone layer comprises a natural stone selected from the list consisting of:

a) granite stone, b) limestone, c) marble stone, d) serpentine stone, e) amphibole stone, and f) soapstone.

5. A cooktop as in claim 1, wherein said plate comprises a steel plate.

6. A cooktop as in claim 1, wherein said plate further comprises:

a laminated composite plate comprising two or more metal layers, said two or more metal layers being selected such that the net thermal expansion of said laminated composite plate is about equal to the thermal expansion of the said natural stone layer.

7. A cooktop as in claim 6, wherein said laminated composite plate further comprises:

a) a core layer of a first metal having a first thermal expansion coefficient, said core layer having first and second major sides; and b) two clad layers of a second metal, one clad on each of said first and second major sides of said core layer, said second metal having a second thermal expansion coefficient, and said first and second metals being selected such that the net thermal expansion of said laminated composite plate is about equal to the thermal expansion of the said natural stone layer.

8. A cooktop as in claim 1, wherein said laminated panel has an edge and at least one thin cut, said at least one thin cut communicating with said top and bottom major panel surfaces and extending at least from one of said first apertures to said edge to relieve stress in said laminated panel.

9. A cooktop as in claim 1, wherein said laminated panel comprises:

a) a first panel portion having said first apertures, and b) a second panel portion having no apertures;

and said plate further comprises:

c) a first plate portion extending substantially under said first panel portion and having said second apertures, and d) a second plate portion extending substantially under said second panel portion and having no apertures, said second plate portion being spaced from said first plate portion by a gap for providing thermal resistance between said first and second panel portions.

10. A cooktop, comprising:

a) a first laminated panel having top and bottom major panel surfaces, said first laminated panel having one or more first apertures therein for accepting heating elements, said first laminated panel comprising:

i) a natural stone layer having top and bottom major stone surfaces, ii) a first adhesive layer disposed against said bottom major stone surface, and iii) a Fiberglas layer, said Fiberglas layer being disposed against said first adhesive layer and being bonded by said first adhesive layer to said bottom major stone surface, thereby reinforcing said natural stone layer;

b) a plate characterized by having tensile strength and thermal conductivity greater than those of said natural stone layer, said plate having one or more second apertures, each of said second apertures being aligned under one of said one or more first apertures to allow energy input to said heating elements; and c) a second adhesive layer disposed between said plate and said bottom major surface of said first laminated panel, whereby said plate is secured to said first laminated panel.

11. A cooktop, comprising:

a) a first laminated panel having an area, top and bottom major surfaces, and one or more first apertures therein for accepting heating elements, said first laminated panel further comprising:

i) a natural stone layer visible at said top major surface and having top and bottom major stone surfaces, ii) a first adhesive layer, and iii) a perforated metal layer bonded by said first adhesive layer to said bottom major stone surface, thereby reinforcing said natural stone layer;

b) a second adhesive layer;

c) a plate characterized by having tensile strength and thermal conductivity greater than those of said natural stone layer, secured by said second adhesive layer to said bottom major surface of said first laminated panel, said plate having one or more second apertures, each aligned under one of said one or more first apertures to allow energy input to said heating elements;

wherein each of said one or more first apertures has a first diameter and each of said one or more second apertures has a diameter smaller than said first diameter of said first aperture under which it is aligned; and d) one or more heating elements supported within said one or more first apertures for heating cookware placed thereon.

12. A cooktop as in claim 11, wherein said natural stone layer comprises a natural stone selected from the list consisting of a) granite stone b) limestone, c) marble stone, d) serpentine stone, e) amphibole stone, and f) soapstone.

* * * * *